United States Patent [19]

Kühner et al.

[11] 4,352,621

[45] Oct. 5, 1982

[54] APPARATUS FOR PARKING MOTOR VEHICLES

[75] Inventors: Ernst E. Kühner, 8 Fere-Champenoise-Strasse, D-7501 Brucchausen; Dieter G. Weinstein, Waldbronn, both of Fed. Rep. of Germany

[73] Assignee: Ernest E. Kühner, Bruchhausen, Fed. Rep. of Germany

[21] Appl. No.: 204,516

[22] Filed: Nov. 6, 1980

Related U.S. Application Data

[63] Continuation-in-part of Ser. No. 883,153, Mar. 3, 1978, abandoned.

[30] Foreign Application Priority Data

Mar. 3, 1977 [DE] Fed. Rep. of Germany ..... 2709202

[51] Int. Cl.[3] ..... E04H 6/40

[52] U.S. Cl. ..... 414/231; 414/263; 414/242

[58] Field of Search ..... 414/231, 263, 252, 242; 104/35, 36, 38, 44; 74/409; 250/231 SE; 318/601, 603, 611, 612, 614

[56] References Cited

U.S. PATENT DOCUMENTS

| | | | |
|---|---|---|---|
| 3,323,030 | 5/1967 | Inaba et al. | 318/603 X |
| 3,465,217 | 9/1969 | Kress | 318/603 X |
| 3,668,377 | 6/1972 | Inaba et al. | 318/603 X |
| 3,675,107 | 7/1972 | Barber | 318/603 X |
| 3,774,100 | 11/1973 | Barber | 318/603 X |
| 3,985,243 | 10/1976 | Kuhner | 414/242 |
| 4,138,633 | 2/1979 | Narikiyo et al. | 318/603 |
| 4,215,300 | 7/1980 | Schmidt | 318/603 |

FOREIGN PATENT DOCUMENTS

| | | | |
|---|---|---|---|
| 1186312 | 4/1970 | United Kingdom | 414/242 |

OTHER PUBLICATIONS

F. T. Gutmann, "18 Ways to Control Backlash in Gearing", Product Engineering, 10/26/59, p. 72.

*Primary Examiner*—Trygve M. Blix
*Assistant Examiner*—Terrance L. Siemens
*Attorney, Agent, or Firm*—Antonelli, Terry & Wands

[57] ABSTRACT

Motor vehicle parking apparatus has pallets for vehicles which are arranged next to each other on a movable construction which is drivable so that each pallet can be brought into line with a predetermined position such as a loading position. In order to achieve accurate alignment of a pallet with the predetermined position, a drive control sysem is used which controls operation of the drive in accordance with an evaluated difference between an actual value derived from an increment transmiter and a predetermined theoretical value dependent on the individual pallet to be aligned. Overrun of the predetermined position is corrected by reversal of the drive under control of a correction signal.

12 Claims, 10 Drawing Figures

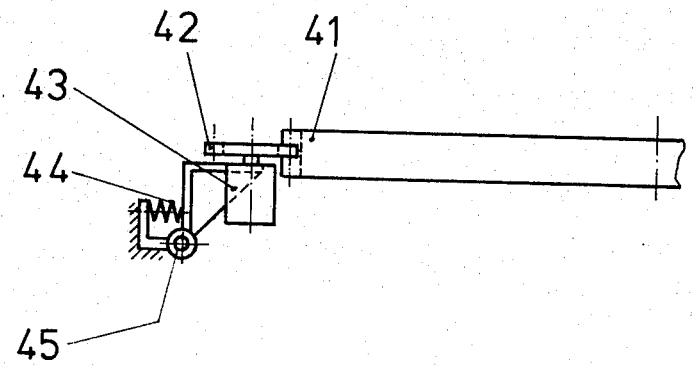
Fig. 3
Fig. 4
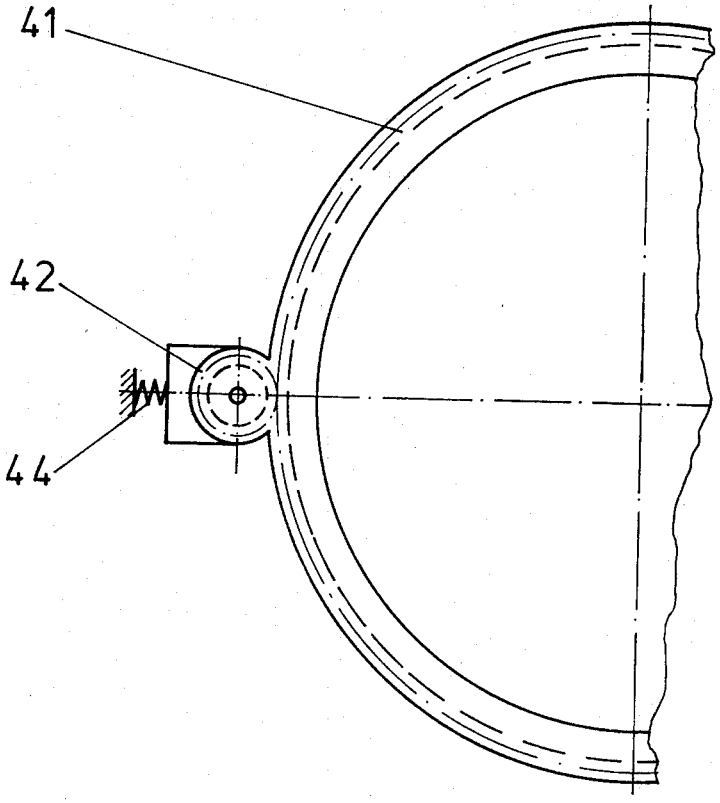

APPARATUS FOR PARKING MOTOR VEHICLES

This is continuation-in-part, of patent application Ser. No. 883,153 filed Mar. 3, 1978, now abandoned.

This invention relates to apparatus for parking motor vehicles on pallets which are arranged next to one another on a movable supporting construction which can be rotated in particular about a central column by means of a drive such that the supporting construction can be positioned at desired positions in its path of movement such as a loading position. Reference is made to my prior United Kingdom Patent No. 1,464,499 which relates to apparatus of this kind.

With such apparatus there is the problem of accurately positioning the individual pallets at at least one desired position, in particular, at a loading position. This is difficult because, on the one hand, the distance between the adjacent pallets has to be kept very small so that occupants of a car can safely get out of the car in, for example, the driving-in position without being endangered due to gaps between the pallets and the fixed footbridge being too large, and because, on the other hand, considerable masses in particular when the parking apparatus is fully loaded with all pallets carrying motor vehicles, have to be accelerated and braked.

The desired accuracy in the positioning is not possible with a conventional control, for example, with a limit switch control. Such a limit switch control also has the drawback that individual pallets cannot be precisely positioned, and the parking apparatus, for example, following a power failure, can only be controlled by hand.

With the object of overcoming the above mentioned difficulties, according to the invention, in an apparatus of the above described type, an increment transmitter is provided which is driven from the supporting construction via a transmission device so as to supply actual value signals representative of the actual position of the supporting construction which are compared with predetermined theoretical value signals representative of the respective desired position of a pallet, and any difference between said signals is arranged to actuate the drive of the supporting construction in a direction appropriate to a reduction of such difference.

The supporting construction may have a toothed rotary rim and the pallets may be arranged next to one another on and extending radially from a column in which case the increment transmitter may be designed suitably as an angle step transmitter, preferably as an opto-electronic absolute angle step transmitter known per se, with which there is associated, with each angular position of the rotary rim, a respective predetermined number of impulses. The angle step transmitter may be driven by the teeth of a pinion which pinion forms the transmission device.

In order to ensure engagement free of play between the pinion and the teeth of the rotary rim under all conditions of operation, the pinion is preferably held pressed on the rotary rim by means of a spring.

The pinion is suitably so dimensioned that one rotation of the rotary rim produces several rotations of the pinion, in particular about ten rotations of the pinion, and that associated with this number of rotations of the pinion there is a predetermined number of steps or impulses, in particular four thousand impulses, one group of which is associated with each pallet. Thereby a substantial resolution of the movement of rotation can be achieved. Associated with each pallet there may be, for example, a certain impulse number with a tolerance ±2 impulses with respect to the loading place, for example, a first pallet may have associated therewith an impulse number of 223, the following pallet an impulse number of 446, the next following pallet an impulse number of 669, etc.

Such numbers of impulses may be stored as the theoretical value signals. By means of a continuous comparison of actual versus theoretical value signals a respective pallet can be moved exactly into a desired position at which point the comparison will produce a difference of zero ±2 impulses.

An important advantage which can be achieved is that the positioning accuracy, in contradistinction to the known positioning methods and positioning arrangements, need not be dependent on oscillation and inertia masses.

In order to render possible a rapid travel of pallets to a desired position, for example, to a loading position, there may be associated with both sides of each pallet, further impulse numbers representing pallet approach positions on achievement of which a reduction of the speed of rotation of the rotary rim is effected so that the pallet arrives delayed at the desired position.

With the arrangement of the invention, it is also possible to effect, upon driving beyond a desired position, due to any malfunctioning a correction and drive back.

A power failure cannot lead to long term malfunction as even when the apparatus is stationary after such a power failure, the actual position of a respective pallet can be immediately corrected.

Accordingly, it is an object of the invention to produce an improved parking pallet system for auto vehicles.

It is a further object of the invention to produce an improved parking pallet system for auto vehicles with control for precise positioning of each pallet for loading.

It is a further object of the invention to produce an improved parking pallet system for auto vehicles with control wherein, upon approach of a pallet to the desired or loading position, speed of the pallet may be reduced.

It is a further object of the invention to provide an improved parking pallet system, wherein precise positioning of the pallet with respect to the loading position may be effected within a prescribed tolerance.

It is an additional object of the invention to produce an improved parking pallet system for auto vehicles wherein, upon overrun past the desired or loading position, a positional correction may be achieved by movement in the opposite direction.

It is an additional object of the invention to produce a parking pallet system wherein, control during an overrun is effected to produce a correction, reduced in magnitude, in order to reduce probable subsequent overrun.

It is a further object of the invention to produce an improved parking pallet system for auto vehicles, wherein a number of impulses are generated during movement of the pallet toward a desired or loading position, which number is compared with a number of impulses assigned to the desired position, the difference in the two values being employed to slow, stop or reverse the system drive based upon a comparison of a number of impulses generated during movement of the pallet toward the desired position and a number of impulses assigned to the desired position, wherein a number of correction impulses are introduced into the comparison operation to reduce the difference between the generated and assigned numbers of impulses in order to achieve a precise pallet position.

It is a further object of the invention to produce an apparatus for parking vehicles on pallets, the pallets being arranged next to one another on a movable supporting construction, the movable supporting construction being rotatable about a central column by a drive means such that the supporting construction can be positioned at desired positions in its path of movement, for example, at a loading position of the pallets, said apparatus including a rotary rim connected to the supporting construction, said rotary rim being provided with a plurality of teeth, a transmission means including a pinion adapted to mesh with the teeth of the rotary rim, an increment transmitter driven by the supporting construction through said transmission means for supplying actual value signals representative of an actual position of the supporting construction, signal comparison means for comparing the actual value signals with predetermined theoretical value signals for a respective desired position of a pallet and for providing an output signal for any difference between the actual value and theoretical value signals, which output signal actuates the drive means of the supporting construction in a direction appropriate to a reduction of such difference.

These and other objects, features, and advantages of the present invention will become more apparent from the following description when taken in connection with the accompanying drawings which show, for the purposes of illustration only, one embodiment in accordance with the present invention, and wherein:

FIG. 3 is a diagrammatic side view of an increment transmitter and a rotary rim of the apparatus of FIG. 1;

FIG. 4 is a plan view of the arrangement of FIG. 3;

Figure 1:
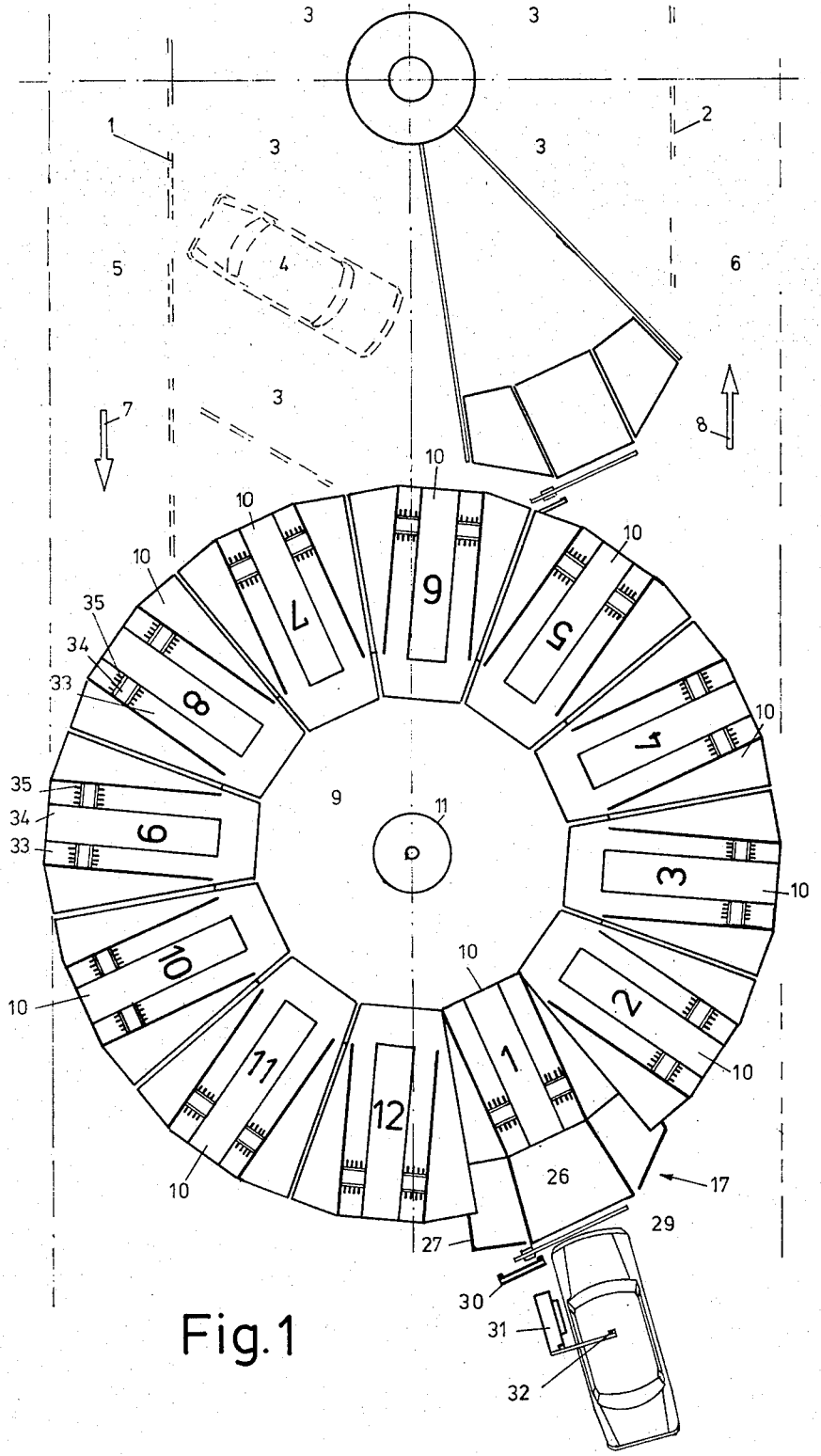
FIG. 1 is a plan of a parking surface and one form of a parking apparatus according to the invention erected thereon.

In FIG. 1 a parking surface with minimum space requirement is shown. The surface has two parallel parking strips 1, 2 on which inclined parking bays 3 for motor vehicles 4 are arranged next to one another. On each parking strip 1, 2 there is an approach lane or drive-in 5, 6 which is provided for space saving reasons as a one-way lane and, for example, is one-way in the direction of the arrow 7, 8. At one end (not shown) of the two parking strips there may be provided, if necessary, a bend connecting the two approach lanes so that the lane leading to the parking surface is at the left and the exit lane at the right. On the other side of the two approach lanes 5, 6 further parallel parking strips may be arranged.

At the ground level parking strips 1, 2 there is arranged an apparatus 9 with parking pallets 10 the ground clearance of which is sufficient to accomodate the usual height of a vehicle (private car or delivery van). Each parking pallet 10 has, at its narrowest place, a width which corresponds at least to the maximum width of the usual vehicle. The parking pallets 10 are arranged radially around a column 11 and the circumference of the arrangement of the parking pallets 10 is selected so that on the one hand the arrangement extends across the whole ground level parking surface including the approach lanes 7, 8, and on the other hand the aforementioned dimension requirement for the width of the parking pallets may be maintained. There results therefore, for example, twelve parking pallets 10. According to requirements, several apparatus 9 may be erected close to one another on the parking strips 1, 2. If several pairs of parking strips are arranged parallel to one another then the apparatus 9 of adjacent pairs of strips may be erected displaced with respect of one another.

Figure 2A:
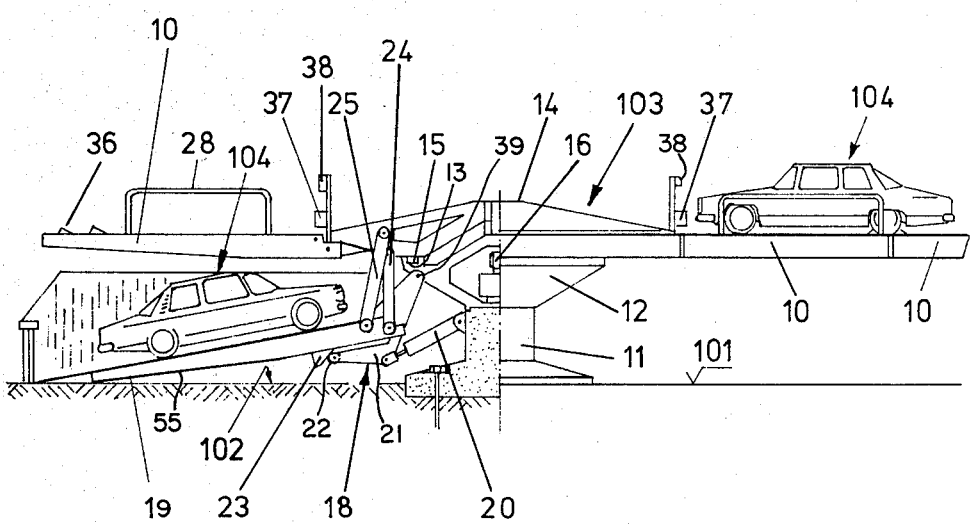
FIG. 2 (A, B) is a side view partly in section of the apparatus of FIG. 1.
Figure 2B:
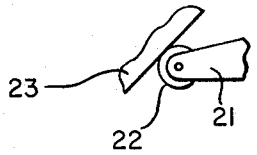

As shown most clearly in FIG. 2, the column 11 is fixed on the ground and, for example, consists of a ready-made part made of steel and concrete. A mushroom-shaped widened portion formed as a steel structure is supported on the column 11 and has a circular bearing surface 13. Above the mushroom-shaped widened portion 12 there is disposed a supporting structure 14 likewise made of steel which is rotatable by means of rollers 15 or the like on the bearing surface 13 and is driven, for example, by an electric motor 16. The parking pallets 10 are arranged radially on the supporting structure 14 and are connected to the structure 14 in the raised position.

At a loading and unloading place generally designated by reference numeral 17 (FIG. 1), arranged similarly to the parking bays 3 at the lower level inclined to the direction of travel 8, the apparatus 9 has a lifting and lowering apparatus generally designated by numeral 18 (FIG. 2) which is engageable on a parking pallet 19 located at that place without being directly secured to such pallet. The parking pallet 19 is identical with all other parking pallets 10. The lifting and lowering apparatus 18 consists, in the illustrated embodiment, of a lifting piston and cylinder assembly 20 which is linked to the column 11 and is hinged to one corner of a triangular lifting lever 21. A further corner 39 of the lifting lever 21 is linked to the mushroom-shaped widened portion 12 and at the third corner of the lever there is a roller 22, FIG. 2A, which loosely contacts a guide piece 23 on the underside 55 of the parking pallet 19. Each parking pallet 10 has such a guide piece 23.

The parking pallets 10, 19 are connected via two links 24, 25 of different length to the supporting structure 14 and in the raised position are fixed to this structure via a locking means not described in detail. The links 24, 25 engage, as shown in FIG. 2, outside the circular bearing surface 13 on the supporting construction and the positions of their engaging points and their lengths are so selected that the parking pallet 19 is inclined slightly in the lowered position. A drive-on slope 26 is provided at a loading and unloading place generally designated by reference numeral 17 to enable driving on to the pallets. Furthermore, at the loading and unloading place a safety shut-off grill 27 is provided which limits outwardly the range of movement of the parking pallet 19. On the parking pallets 10, 19 there may furthermore be provided handrails 28 for safety. In front of the loading and unloading place 17 there is placed a barrier 29 and if necessary a signal light 30. In front of the barrier 29 there is a control box 31, for example, an automatic parking ticket machine, and a limiter 32 for the highest possible clearance space profile of the vehicles capable of being received by the apparatus 9.

The parking pallets 10, 19 may, as can be seen in FIG. 1, have parallel recessed track grooves 33. At the rear end of each parking pallet 10, 19 a crosswise channel 34 may be provided so that the driver driving onto the parking pallet will know when his vehicle is in the correct position. Behind and if necessary also arranged in front of this crosswise channel 34 are recesses 35 by means of which blocking wedges 36 or the like (FIG. 2) can engage from underneath by means of which rolling off of the vehicle can be prevented. At the front end, the parking pallets 10, 19 may have buffers 37 and a signal lamp 38 coupled thereto which indicates the correct position of the vehicle and co-operates with an electric locking means for the lifting movement of the apparatus 18.

Reference is made to my prior United Kingdom Patent No. 1,464,499 for a further understanding of the apparatus so far described.

FIG. 3 shows for the parking apparatus only one rotary rim 41 of the supporting structure 14 and one increment transmitter, in the form of conventional opto-electronic absolute angle step transmitter, 43, which is driven via a sensing apparatus in the form of a pinion 42 from the rotary rim 41. The angle step transmitter is linked to a stationary pivot 45 and is loaded by means of a compression spring 44 which cancels any play between the teeth of the pinion 42 and the rotary rim 41.

In the exemplary embodiment shown, the pinion 42 is so dimensioned that on one rotation of the rotary rim 41 it makes ten rotations. Associated with the rotational path are in all about 4000 impulses of the absolute angle step transmitter 43 so that a substantial resolution and thus a high degree of positioning accuracy results. It will be appreciated that the number of impulses selected for a complete single rotation of the rotary rim may be increased or decreased dependent upon whether a higher or lower resolution is desired. Thus, the figure of 4000 is given as exemplary only. Associated with each pallet 10, 19 there is a respective impulse number related to the loading position. For example, the pallet No. 1 (See FIG. 1) has associated therewith the impulse No. 223, the pallet No. 2 the impulse No. 446, the pallet No. 3 the impulse No. 669, etc. An acceptable tolerance of the impulse number for each pallet is determined and in the example shown may amount to $\pm 2$. Associated with each side of each pallet are further impulse numbers, on reaching which, the speed of rotation of the rotary rim 41 for the driving to the desired position is reduced to a slow speed.

The absolute angle step transmitter 43 may be of a construction usual in the trade such as, for example, that described in the prospectus 2/4/76/3000 of the firm Max Stegmann.

In operation, the angle step transmitter 43 is driven by the rotary rim 41 and supplies for each position of rotation of the rotary rim, and thus of the pallets 10 brought onto it, an actual value signal. A comparison with stored corresponding theoretical value signals and an appropriate effect on the driving of the rotary rim 41 renders possible an accurate positioning of each pallet in any desired position in particular in the loading position at 17.

Figure 5:
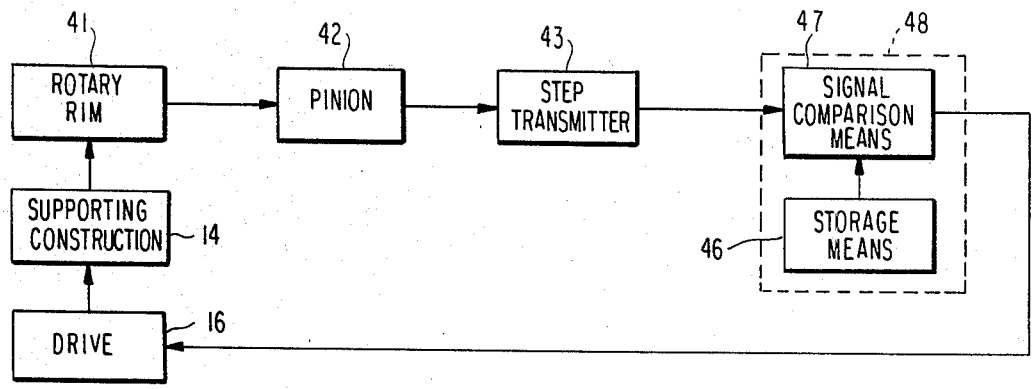
FIG. 5 is a block diagram of a control system according to the invention.

The manner in which the system operates may be seen from the block diagram of FIG. 5 wherein the rotary rim 41 imparts a rotation to pinion 42, the magnitude of rotation being sensed by step transmitter 43 to generate, in the example here employed, 10 pulses for each rotation of pinion 42. The impulses from step transmitter 43 are input to a signal comparison means 47. A second input is accepted by signal comparison means 47 from storage means 46. The number of impulses representing the output of step transmitter 43 is compared, as for example, by subtraction with the number of impulses accepted from storage means 46. The difference between the two is employed to impart control to the drive 16 which serves to generate the movement for the supporting construction 14 and then to the rotary rim 41. The output of the signal comparison means 47 is thus employed to provide rotary rim 41 with fast rotation which is slowed upon approach to the desired or loading position and ultimately to a stop within a tolerance limit. If overrun of the desired location occurs, a corrective signal may be provided to reverse rotation and approach the desired location from the opposite direction as the result of signal comparison in 47.

Storage means 46 and signal comparison means 47 may be part of a control device 48 indicated in dotted lines in FIG. 5. The control device 48 may take a variety of forms, as will be apparent to the skilled artisan, for example, it may comprise a hard wired computer wherein the various logic operations necessary to effect high speed, slow speed, stop within tolerance and movement in the opposite direction to effect correction upon overrun, are effected digitally.

By the same token, a programmable digital computer may be employed for control device 48 wherein appropriate programming is employed to effect the desired control outputs to the drive.

The particular implementation selected will depend upon the desires of the practitioner.

However, within the spirit of the invention, any embodiment employed will serve to effect an input, for example, from control means 31 indicating an assigned impulse number corresponding to a particular pallet. Such an input would, for example, be supplied by the pallet operator stationed, for example, adjacent control box 31. Impulses input from the step transmitter 43 would be input to such a device 48. Upon performing logic functions, either by specially designed hardware or by general purpose hardware suitably programmed, control device 48, will provide the high speed, reduced speed upon approach, stop and correction controls.

The details for such operations will now be described, in connection with FIG. 6. The mode of operation is described in terms of a flow chart of a program for a programmable digital computer. Such a device will have, as is well known in the art, appropriate input/output (I/O) devices, memory and arithmetic/logic units. FIG. 6, it should be pointed out, may also be considered as designating the necessary operations to be performed in a hardwired special purpose digital computer.

Turning to FIG. 6, it will be seen that four registers are provided, an X register for storing or accumulating the impulses received from the step transmitter 43 of FIG. 5, a Y register for receiving the impulses input from storage means 46, a Z register for storing the number of impulses to be used in identifying the point at which slow speed is undertaken in approaching the desired position. And, finally, a T register for storing the number of impulses to be used in establishing the acceptable tolerance to be employed in controlling the position of the rotary rim in generating a stop signal therefor.

It will be recognized that when the system of the invention is in continuous use, movement will be effected of the rotary rim, bringing successive pallets to the loading position so that the starting point for any single movement operation is the end point, with the pallet last used in the loading position, of the last loading operation.

It will be assumed for the purposes of describing the operations in connection with FIG. 6, however, that the system will be employed in "start-up" mode. The program begins at 100, the X, Y, Z and T registers being cleared at step 101.

It is necessary to establish the tolerance found to be acceptable for the stop position. An exemplary value of plus or minus two impulses will be employed, and accordingly, the value 2 is input to register T in step 102.

The pulse positions for each pallet, with respect to which slow speed is to be effected in approaching the loading platform, is established by storing a value in the Z register. An exemplary value of 23 impulses will be employed for the description and thus the value 23 will be stored in the Z register as shown in step 102.

As previously explained, each pallet has a certain number of impulses associated therewith as representing its relative location with respect to a loading platform, the number 223 being indicated for a first pallet. It will be assumed for the purposes of the explanation, that pallet no. 1 (223 impulses) is to be loaded. The operator at control box 31 of FIG. 1 will input, as by way of a keyboard a value which by way of the program will represent the impulse no. 223, thus causing 223 impulses, or a number representative thereof to be stored in the Y register.

It should be noted in passing that in the start-up mode the rotary rim is assumed to be at its zero pulse location and thus 223 impulses away from the first pallet.

Because the system is in the start-up mode, the initial setting for the X register is thus zero. Since the register was cleared in step 1, the value zero is the condition for the X register in step 103.

Entry of the value for the Y register representing the first pallet to be moved to the loading position in the Y register is the signal for the system to begin and a comparison is made between the X and the Y values, 0 and 223 respectively, at step 104. This operation is effected by input to the arithmetic unit of the computer of the values standing in the X and Y registers, performing a subtraction and noting the sign of the difference. As the rotary rim 41 begins to move in order to place the selected "223" pallet at the loading position, successive comparisons will be performed as explained in connection with step 104. Thus, after, for example, movement of the rotary rim has generated four pulses in the X register, a comparison with the Y register value, 223 will produce a large difference, 219. Successive differences will be registered by such successive comparisons, the differences being sequentially reduced as the rotary rim causes the pallet "223" to move toward the loading position. The difference between the X and Y values, together with its sign are stored in step 105, iteratively, to be replaced upon the performance of the next comparison with a new difference value and sign.

The next process to be performed is the comparison of the sign of the stored difference in step 105 with the sign of the difference newly performed in step 103. As shown at 106, this comparison is performed and the results stored. The result is employed in correction for overrun to be described subsequently. Suffice it to say that pallet "223", as it begins its movement toward the loading position, causes successive tests of the sign at step 107 which will show no sign change until final overrun of the loading position. Such tests will produce a "no" answer leading to a further test at step 111.

This is a test to determine whether the pallet has approached the point at which speed should be reduced, that is, for the example employed, at the point located 23 pulse positions earlier than the assigned value for the pallet 223, thus, the X register value is to be compared with the value standing in the Y register minus the value standing in the Z register in order to determine which is greater. For the example employed, the value (Y−Z) equals (223-23) equals 200. If the pallet and rotary rim 41 have not reached a point where X is greater than (Y−Z), a "no" response is determined in step 111 and the procedure of receiving and storing impulses in the X register from the step transmitter 43 continues as indicated by the line 112. It will be appreciated that, had the pallet been approaching the loading position from the opposite direction, the threshold value would be determined (Y+Z) so that step 111 is indicated as performing a double comparison in order to determine the relationship of the value from the X register in relation to the 2 threshold values for changing speed.

Figure 6A:
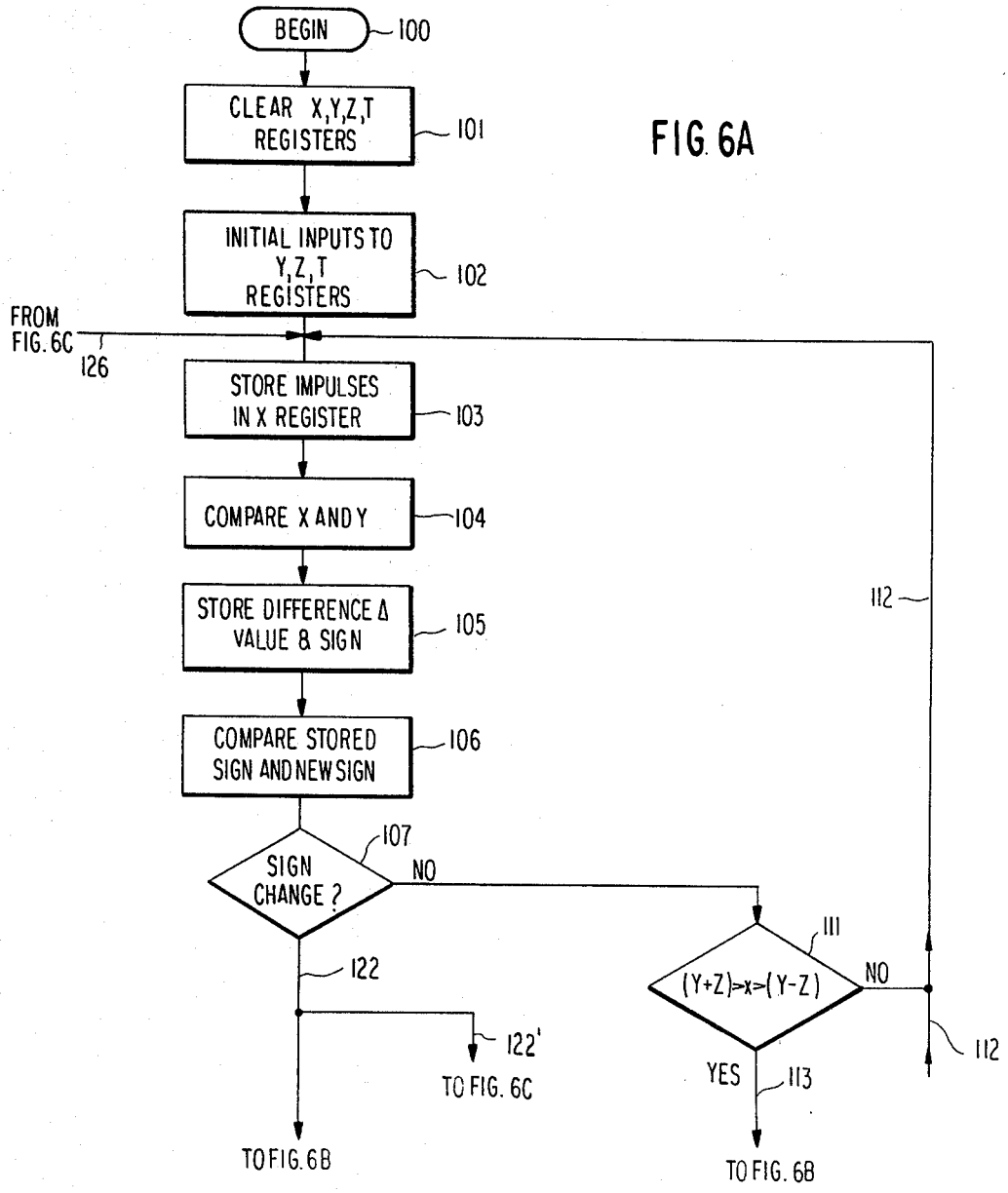
FIG. 6 (A–C) is a flow chart of operations performed in connection with the control system of the invention.
Figure 6B:
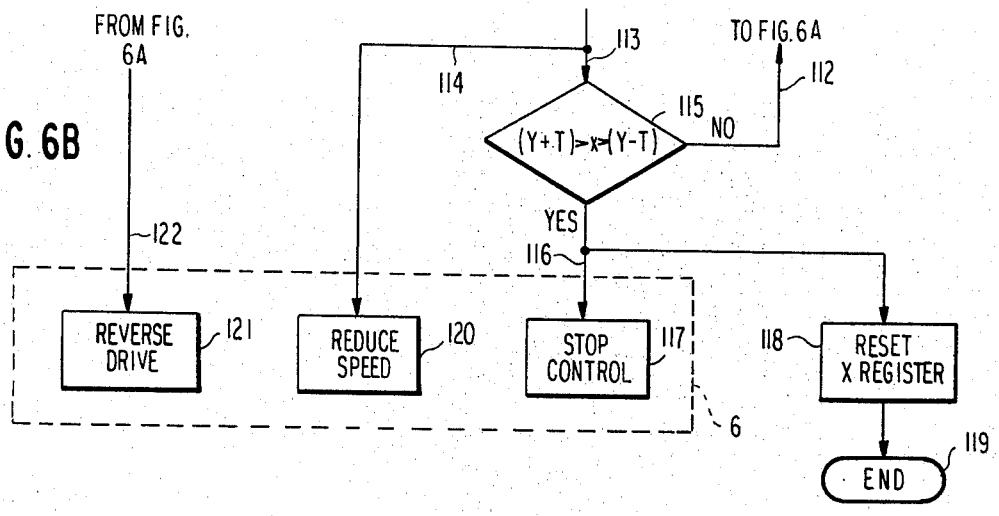

Upon determination of a YES response as shown at line 113, device 48 transmits a signal to the motor control of drive 16 to reduce speed as shown on line 114, FIG. 6B.

The pallet 10 and rotary rim 41 now approach at reduced speed the loading position and it is necessary to determine when the STOP signal should be transmitted. A test is performed in block 115 to determine whether X has yet risen to be greater than (Y−T). It will be remembered that the value standing in the T register represents the tolerance value for the pulse position, within which the pallet 10 must lie, in order to justify stopping the movement of the rotary rim 41. If the test in 115 indicates a NO result, the movement of the rotary rim 41 continues as indicated by line 112 together with the attendant admission of further pulses to the X register as shown in block 103. Again, had the movement of the rotary rim 41 and pallet 10 been from the opposite direction in approaching the loading position, the comparison would have been between the value of X and the value of (Y+T). The receipt of a YES condition in block 115 is an indication that the pallet is within tolerances at the loading position and should be stopped, and, accordingly, a stop signal issues on line 116 to the stop control 117 of the motor drive 16.

At this point, it may be desirable to reset the X register to a value equivalent to what is standing in the Y register, that is, the number of pulses corresponding to the pallet 223 when it is in the loading position.

The reasons for resetting the X register derives from a variety of sources for the reason that mechanism-dependent variables such as viscosity of hydraulic oil which is itself temperature-dependent, employed in the rotary mechanism, mechanical inaccuracies, differing weights and the like may cause the theoretical values of the necessary pulses to position a particular pallet 10 at the loading position may differ. Thus, it is expedient to assure that the X register has an appropriate value standing in it in preparation for the next movement. Further, as will be seen from the following explanation of the overrun correction, the number of pulses standing in the register may be different by virtue of an overrun correction.

Figure 6C:
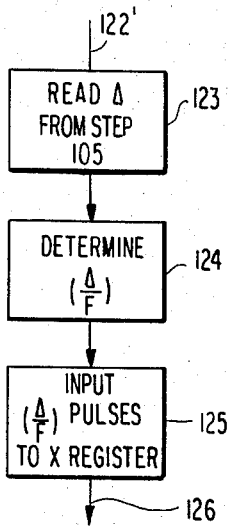

The procedure performed upon occurrence of an overrun is shown in FIG. 6C. The inertia of the large mass which characterizes the mushroomed structure of number 103 of FIG. 2 and attendant moving mechanisms may cause the pallet "223" to overrun the loading position. This condition is identifiable by the fact that the sign of the differences of the number of impulses standing in the X and the Y registers changes as determined in step 107, previously described. For example, if the pallet "223" has been approaching the loading position in a direction which causes the number of pulses stored in the X register in step 103 to continuously rise, at some point, the value of standing in the X register will continue to approach the value 223 standing in the Y register, but during this time the sign stored for the difference will be "+" in as much as Y will be greater than X. At the instant when the number of pulses in the X register exceeds the value standing in the Y register, it will be apparent that the sign of the difference Y−X will change and this is evidenced by an output on line 122 in FIG. 6A. The signal on line 122 is transmitted to the reverse drive 121 of the drive 16 as shown in FIG. 6B to cause the drive to perform a corrective movement. It will be observed, however, that if such corrective movement proceeds at the rate effected by the drive in achieving the overrun condition, a further overrun in the opposite direction may take place resulting in additional undesirable time delay in arriving at the loading position. To avoid such multiple overrun, it may be expedient to adjust the value of the impulses standing in the X-register in step 103.

Figure 7:
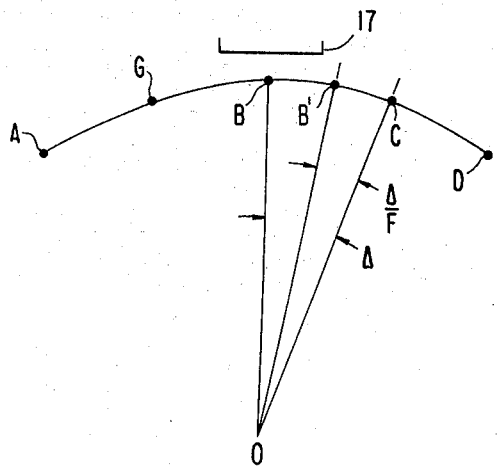
FIG. 7 is a diagram illustrative of overrun correction as effected by the invention.

This is effected by receiving on line 122' in FIG. 6C, the indication of a sign change detected in step 107 of FIG. 6A. The difference stored in step 105 of the most recent comparison made in step 104 is read at step 123. The value of Δ will be employed to correct the value standing in the X register, however, in order to reduce the chance of a subsequent overrun, it is reduced by a factor F. Thus, in step 124, the value Δ is divided by F to produce an output value which will be employed to correct the value standing in the X register. In practice, it has been found expedient to reduce Δ by a factor of 2, that is, half the number of pulses represented by Δ is used to correct the value in the X register. In step 125, this value is input to the X register on line 26 as shown in FIGS. 6A and C. It will be appreciated, that the value applied to correct the value standing in the X register, must be in a sense which will prevent further overrun. This will be understood from an inspection from FIG. 7. If the pallet 10 approaching the loading position 17 from the direction of point A overruns the loading position point B and takes a position in overrun at point C, the number of pulses stored as Δ after the most recent comparison would represent the angle C-O-B the number of pulses applied to the storage register X would not be Δ but in fact a number Δ/F representing a correction of less than Δ. The ensuing motion of the rotary rim 41 with attendant pallets 10 will, considering backlash and the like as previously explained, bring the pallet in line with a loading position 17. In such a circumstance, if the pulses input to the X register as the pallet proceeded from A to D were increasing, then the correction Δ/F must be added to the value already standing in the X register. This has the effect of making the value standing in the X register appear to the electrical and mechanical system as if the point B were in reality at B'. Thus, as the rotary rim 41 and attendant pallets 10 reverse their direction, the correction applied will be less than the total value implied by the value Δ however, the effect of the various physical factors previously described may be expected to cause the system to overrun B' to bring the pallet 10 in line with the loading position 17. The value F, it will be understood, may be determined by the practitioner of the invention and adjusted to cause correct registration. The value for F may be a whole number or a fractional number. In one embodiment, the factor F employed has been 2.

It will be noted, had the pallet been proceeding toward the loading position 17 from the point D, overrun would have occurred to a point such as G and the correction would have been made in the opposite sense, toward position B by a comparable factor Δ/F. In either event, the artisan will recognize that the correction will be applied in a sense to cause the rotary rim 41 together with pallets 10 to arrive at the loading position 17 by applying a correction which counteracts the effects of the mechanical characteristics of the system as to temperature, viscosity of hydraulic oil, friction, backlash, and the like.

When the invention described is practiced by means of a program introduced to a programmable digital computer, the exact architecture of the program in carrying out the steps described will, of course, vary depending upon the desires of the programmer, the architecture of the particular computer and its attendant operating system, the particular programming language employed, either machine, assembly or user oriented language and the like, with departing from the spirit of the invention set forth.

For example, it may be expedient to store simultaneously in memory all of the home position pallet pulse numbers, for example 223, 446, 669, and the like. The program then may select the appropriate composition pulse number, for use in its program under control of console 31.

While we have shown described only one embodiment in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

What is claimed is:

1. An apparatus for parking motor vehicles on pallets, the pallets being arranged next to one another on a movable supporting construction, the movable supporting construction being rotatable about a central column by a drive means such that the supporting construction can be positioned at desired positions in its path of movement, for example, at a loading position of the pallets, said apparatus including a rotary rim connected to the supporting construction, said rotary rim being provided with a plurality of teeth, a transmission means including a pinion adapted to mesh with the teeth of the rotary rim, an increment transmitter means driven by the supporting construction through said transmission means for supplying actual value signals representative of an actual position of the supporting construction, signal comparison means for comparing the actual value signals with predetermined theoretical value signals for a respective desired position of a pallet and for providing an output signal for any difference between the actual value and theoretical value signals, and output signal responsive means for actuating the drive means of the supporting construction in a direction appropriate to a reduction of such difference.

2. An apparatus according to claim 1, wherein the increment transmitter means is an angle step transmitter means driven by said pinion.

3. An apparatus according to claim 2, wherein a spring means is provided for pressing said pinion against the teeth of the rotary rim.

4. An apparatus according to claim 2, wherein the pinion is so dimensioned that a rotation of the rotary rim produces several rotations of the pinion, and a rotation of the pinion produces a first predetermined impulse count from the angle step transmitter means, and wherein a second predetermined impulse count is associated with each pallet.

5. An apparatus according to claim 4, wherein the pinion is dimensioned such that approximately ten rotations of the pinion correspond to one rotation of the rotary rim, and wherein one rotation of the rotary rim provides a third impulse number of about 4000.

6. An apparatus according to claim 4, characterized in that a fourth impulse count different from said second predetermined impulse count is associated with each pallet, and wherein a reduction of the speed of the rotary rim is effected when the fourth impulse number for the respective pallet is reached.

7. An apparatus according to claim 2, wherein the angle step transmitter is formed as an opto-electronic absolute transmitter, a rotation of the rotary rim produces a predetermined impulse count, and wherein rotation to each desired position of the rotary rim from a reference position representing zero pulses provides a specific predetermined impulse count for the respective desired positions of the rotary rim.

8. In an apparatus for parking motor vehicles on pallets, the pallets being arranged next to one another on a movable supporting construction, the movable supporting construction being rotatable about a central column by a drive means such that the supporting construction can be positioned at a desired position in its path of movement, including a rotary rim connected to the supporting construction, said rotary rim being provided with a plurality of teeth, a transmission means including a pinion adapted to mesh with the teeth of the rotary rim, an increment transmitter driven by the supporting construction through said transmission means for supplying actual value signals representative of an actual position of the supporting construction, the improvement comprising:

first means to control said drive means to reduce speed thereof when a selected pallet to be positioned at said desired position assumes a predetermined position prior to arriving at said desired position.

9. Apparatus for parking motor vehicles on pallets according to claim 8, wherein said first means comprises second means to store a number X representative of the present position of said selected pallet third means to store a number Y representative of a desired position for said selected pallet fourth means to reduce speed of said drive means when the difference in magnitude between X and Y falls below a predetermined value.

10. In an apparatus for parking motor vehicles on pallets, the pallets being arranged next to one another on a movable supporting construction, the movable supporting construction being rotatable about a central column by a drive means such that the supporting construction can be positioned at a desired position in its path of movement, increment transmitter means driven by the supporting construction through said transmitter means for supplying actual value signals representative of an actual position of the supporting construction, the improvement comprising:

first means to control said drive means to reduce the speed thereof when a selected pallet to be positioned at said desired position assumes a predetermined position prior to arriving at said desired position, wherein said first means comprises second means to store a number X representative of the present position of said selected pallet, third means to store a number Y representative of a desired position for said selected pallet, fourth means to reduce the speed of said drive means when the difference in magnitude between X and Y falls below a predetermined value, and means for stopping said drive means when the difference in magnitude between X and Y falls below a second predetermined value which is less than said first predetermined value.

11. In an apparatus for parking motor vehicles on pallets, the pallets being arranged next to one another on a movable supporting construction, the movable supporting construction being rotatable about a central column by a drive means such that the supporting construction can be positioned at a desired position in its path of movement, increment transmitter means driven by the supporting construction through said transmitter means for supplying actual value signals representative of an actual position of the supporting construction, the improvement comprising:

first means to control said drive means to reduce the speed thereof when a selected pallet to be positioned at said desired position assumes a predetermined position prior to arriving at said desired position, wherein said first means comprises second means to store a number X representative of the present position of said selected pallet, third means to store a number Y representative of a desired position for said selected pallet, fourth means to reduce the speed of said drive means when the difference in magnitude between X and Y falls below a predetermined value, and fifth means to reverse the direction of said drive means when said pallet passes through said desired position.

12. Apparatus for parking motor vehicles according to claim 11, wherein said fifth means comprises;

sixth means for identifying a change of sign in said difference to effect said reversal of said drive means.

* * * * *